US008282780B2

(12) United States Patent
Maijala et al.

(10) Patent No.: US 8,282,780 B2
(45) Date of Patent: Oct. 9, 2012

(54) METHOD AND APPARATUS FOR PRE-TREATMENT OF FIBRE MATERIAL TO BE USED IN THE MANUFACTURE OF PAPER, BOARD OR THE LIKE

(75) Inventors: Mikko Maijala, Espoo (FI); Björn Lax, Vasa (FI); Roope Maijala, Espoo (FI); Matti Sipilä, Kuusankoski (FI); Päivi Solismaa, Kuusankoski (FI)

(73) Assignees: FP-Pigments Oy, Espoo (FI); UPM-Kymmene Oyj, Helsinki (FI)

( * ) Notice: Subject to any disclaimer, the term of this patent is extended or adjusted under 35 U.S.C. 154(b) by 971 days.

(21) Appl. No.: 10/561,387

(22) PCT Filed: Jun. 15, 2004

(86) PCT No.: PCT/FI2004/000366

§ 371 (c)(1),
(2), (4) Date: Mar. 20, 2007

(87) PCT Pub. No.: WO2005/005725

PCT Pub. Date: Jan. 20, 2005

(65) Prior Publication Data

US 2007/0272376 A1 Nov. 29, 2007

(30) Foreign Application Priority Data

Jul. 15, 2003 (FI) ..... 20031072

(51) Int. Cl.
*D21C 7/14* (2006.01)

(52) U.S. Cl. ..... 162/243; 162/9

(58) Field of Classification Search ..... 162/243, 162/9
See application file for complete search history.

(56) References Cited

U.S. PATENT DOCUMENTS

| | | | | |
|---|---|---|---|---|
| 5,223,090 | A * | 6/1993 | Klungness et al. | 162/9 |
| 6,416,727 | B1 * | 7/2002 | Virtanen | 423/432 |
| 6,471,825 | B1 | 10/2002 | Doelle et al. | 162/9 |
| 2004/0154771 | A1 | 8/2004 | Rheims et al. | 162/183 |

FOREIGN PATENT DOCUMENTS

| | | | |
|---|---|---|---|
| WO | WO 96/18454 | A * | 6/1996 |
| WO | WO 98/29596 | | 7/1998 |
| WO | WO 99/54045 | | 10/1999 |
| WO | WO 02/40773 | | 5/2002 |
| WO | WO 0240773 | A1 * | 5/2002 |
| WO | WO 02/072945 | | 9/2002 |
| WO | WO 03031717 | A1 * | 4/2003 |

* cited by examiner

*Primary Examiner* — Eric Hug
*Assistant Examiner* — Jacob Thomas Minskey
(74) *Attorney, Agent, or Firm* — James C. Lydon

(57) ABSTRACT

A method and apparatus for pretreating fiber material to be used in manufacturing paper or the like, for example, by precipitating mineral substances to the fibers. During precipitation, fiber material, which is advantageously pretreated in a through-flow mixer operating on the principle of an impact mill, is fed to the precipitation reactor. Gas is led to the precipitation reactor in order to generate a gas space in the reactor. The gas contains a substance, which precipitates the mineral substance such as carbon dioxide ($CO_2$). The fiber material is fed to the gas space of the precipitation reactor as small liquid and solid substance fractions such as drops and/or particles.

25 Claims, 6 Drawing Sheets

METHOD AND APPARATUS FOR PRE-TREATMENT OF FIBRE MATERIAL TO BE USED IN THE MANUFACTURE OF PAPER, BOARD OR THE LIKE

The present invention relates to a method and apparatus according to the preambles of the independent patent claims presented later in this patent application for pretreating fibre material to be used in manufacturing paper, paperboard or the like, for example when precipitating mineral substances to fibres.

Fillers rich in minerals such as natural, finely ground calcium carbonate, precipitated calcium carbonate (PCC), kaolin clay and talcum are used in manufacturing paper to improve various characteristics, such as optical and printing characteristics, of paper. Adding filler also makes it possible to use less fibre material in paper manufacture. Cost savings thus obtained are generally clearly higher than the costs created by adding a filler material.

Therefore, a general aim is to add as much filler material as possible into the fibre suspension to be used in paper manufacture. However, no more than 20-25% of a filler material such as calcium carbonate can be added to paper for reasons concerning the strength properties of paper.

To increase the amount of calcium carbonate in the paper, it has been suggested that a calcium containing filler material be added to the fibre suspension in the form of calcium hydroxide, and subsequently convert the calcium therein to precipitated calcium carbonate by adding carbon dioxide. Thus, it is possible to promote precipitation and attachment of calcium carbonate directly on the fibre surfaces, as well as inside the fibres, and thus to increase the amount of carbonate in the paper.

Disadvantages of these known solutions, however, can be considered as follows:

- precipitation reactions take a relatively long time,
- precipitation reactions are partially incomplete,
- processes used are not continuous, or
- apparatuses used are not easy to integrate into the paper manufacturing process.

It is suggested in the American patent U.S. Pat. No. 6,471,825 that the calcium hydroxide added to the fibre suspension should be precipitated directly into the fibres in the form of calcium carbonate. The patent suggests that the suspension containing fibre and calcium hydroxide should first be treated in a disc refiner type of an apparatus for disintegrating possible fibre lumps before feeding the carbon dioxide gas into the suspension.

In disc refiner types of devices the fibre suspension undergoes harsh treatment, weakening the fibre material. After the addition of carbon dioxide, the fibre suspension is mixed in a screw mixer. However, it is difficult to ensure quick and efficient mixing of carbon dioxide and calcium hydroxide, and the completion of reactions, with precipitation reactors equipped with ordinary blade or screw mixers. Moreover, it is difficult to promote the attachment of precipitated calcium carbonate to the fibres in these devices.

On the other hand, it is suggested in the American patent U.S. Pat. No. 5,679,220 that the calcium hydroxide added to the fibre suspension should be precipitated in the fibres in the form of calcium carbonate using carbon dioxide gas, as the fibre suspension flows through a long, two-part pipe-type of reactor with a smooth interior. The suspension containing calcium hydroxide is fed to the fibre suspension in the middle of the first part of the pipe-type reactor. Carbon dioxide gas is fed to the fibre suspension both before and after feeding the calcium hydroxide suspension therein. Carbon dioxide gas is directed to the reactor through an opening on its wall. The aim is to promote absorption of the gas into the suspension flowing inside the pipe. The dwell-time of the fibre suspension in a relatively long mixing reactor—more than 2 meters—is more than 1 minute.

Therefore, the purpose of the present invention is to present a better method and apparatus for precipitating the mineral particles into the fibres to be used in manufacturing paper, paperboard or the like.

The purpose of the invention is to present a method and apparatus, whereby the problems of the above-mentioned known technology are minimised.

The purpose of the invention is thus to present a method and apparatus whereby it is possible to obtain a high level mixing of fibres and minerals such as calcium hydroxide, or calcium oxide, and a precipitation chemical such as carbon dioxide gas, during the precipitation process.

The purpose of the invention is also to present a method and apparatus whereby it is possible to initiate and complete the precipitation of calcium carbonate on the surface of and inside the fibres in a very short time, and as completely as possible.

The purpose of the invention is also to present a method and apparatus whereby it is possible to increase the filler content of paper compared to a conventional practice.

Moreover, the purpose of the invention is to present a method and apparatus whereby it is possible to influence the characteristics of paper, paperboard and corresponding product as desired, typically to their optical and strength characteristics.

The purpose of the invention is also to present a method and apparatus which are suitable for use in precipitation of a mineral substance to fibres of highly various fibre suspensions, and to other solid substances possibly residing in the fibre suspension.

In addition, the purpose of the invention is also to present an apparatus which operates continuously, and is easy to integrate in to the manufacturing process of paper, paperboard or the like.

To achieve the above-mentioned objectives, the method and the apparatus according to the invention are characterised by the characterising parts of the independent claims presented later in this patent application.

The present invention concerns a method for precipitating mineral particles in to fibres to be used in manufacturing paper, paperboard or the like, which method generally includes the following steps:

(a) a fibre material containing fibre to be used in manufacture is fed into the precipitation reactor;
(b) a reactive mineral substance, typically calcium hydroxide ($Ca(OH)_2$), is fed in to the precipitation reactor;
(c) the fibre material and reactive mineral substance are combined to form a fibre suspension in the precipitation reactor and/or before these substances are fed in to the precipitation reactor;
(d) the fibre suspension in the precipitation reactor is brought into contact with a substance, typically with $CO_2$, which precipitates the said reactive mineral substance, to achieve at least partial precipitation of the reactive mineral substance in the fibre suspension, whereupon at least part of the thus formed precipitated mineral substance precipitates onto the fibres—on the surfaces of fibres and/or inside the fibres—in the fibre suspension, and
(e) the thus treated fibre suspension is directed out of the precipitation reactor.

It is now suggested in a typical solution according to the invention that (f) gas, containing a substance precipitating the above-mentioned reactive mineral substance, such as carbon dioxide, is fed in to the precipitation reactor to generate a gas space containing the said precipitating substance in the precipitation reactor and that (g) the fibre suspension fed into, and/or formed in, the precipitation reactor is dispersed, i.e. disintegrated into small parts such as droplets and/or particles containing solid matter and/or liquid, into the said gas space.

Typically, the gas containing the precipitant is fed in to the precipitation reactor as a continuous gas flow in order to maintain the desired gas space in the reactor. The amount of the precipitant in the gas can vary extensively, for example, depending on the source and quality of the precipitating gas and/or desired paper characteristics. The gas to be fed in to the precipitation reactor generally contains >5%, typically >10%, and if desired even 100% of precipitant such as carbon dioxide. The gas containing the precipitant can thus be, for example, pure or nearly pure carbon dioxide, combustion gas or some other suitable gas or gas mixture containing carbon dioxide. Of course, it is possible to use a precipitant other than carbon dioxide, which is suitable for precipitation of the used reactive mineral substance. Gas is typically fed in to the precipitation reactor so that overpressure is maintained in the precipitation reactor.

In the solution according to the invention, the aim is to feed the fibre suspension, its liquid and solid phases, into the gas space disintegrated as tiny parts, drops and/or particles. In that case, the fibre suspension is disintegrated using any known or novel method, into pure liquid-like drops—liquid drops containing solid matter such as fibres and mineral substances, solid particles and/or solid particles covered with liquid. In that case, the fibre material in the fibre suspension is disintegrated at least partially into separate fibres. The liquid phase of the fibre suspension, on the other hand, is dispersed mostly to <10 mm, typically to <1 mm liquid drops. Small liquid drops, fibres and other solid particles are dispersed into the gas space as a mist-like gas suspension in which the volume flow is much greater than the volume flow of the fibre suspension fed to the reactor. This creates a large contact area between the fibre suspension drops and/or particles and the surrounding gas, enabling very quick and complete precipitation reactions between the reactive mineral substance to be precipitated and the precipitant in the gas.

When applying the solution according to the invention, it can also be assumed that nearly every separate fibre is surrounded by a gas envelope which induces the precipitation of mineral substances from the surrounding liquid onto the surface of the fibres, and inside the fibres quickly and efficiently. Earlier, the process was the opposite and the aim was to feed the gas as fine bubbles into the more or less thick fibre suspension in which case the precipitation was not as quick and complete.

When applying the solution according to the invention, highly active areas of the precipitated material are formed on the fibres through which, it can be assumed, the fibres form reciprocal bonds with each other as the precipitation reactions continue in these parts. These bonds improve the strength characteristics of paper to be manufactured.

According to one advantageous embodiment of the invention, when considering the flow of the fibre material, an activation zone is formed in front of the precipitation reactor, or in the precipitation reactor, advantageously at the beginning of the reactor. In the activation zone, forces are directed to the fibre suspension, which for example, either tribomechanically or tribochemically, activate the fibres increasing their capacity to form bonds with each other, or to absorb precipitating and/or precipitated mineral substances. The activation of fibres improves the strength characteristics of the paper to be manufactured.

In the activation zone, it is preferable to both disperse the fibres of the suspension to small drops and/or particles and to activate them simultaneously. Activation works advantageously in alkaline conditions when the fibres are swollen resulting from the addition of $Ca(OH)_2$, for example.

In the activation zone, for example, recurrent, sequential impacts, double impacts, shear forces, turbulence, over- and underpressure pulses and other corresponding forces, which mechanically activate the fibres, especially their surfaces, for example, by fibrillating or grinding the fibres or by opening fibre lumens to mineral substances, can be directed to the fibre suspension. On the other hand, fibres, especially fibre surfaces, can thus be chemically activated so that active $OH^-$-groups are formed on the fibre surfaces.

According to an advantageous embodiment of the invention, activation can be initiated, for example, in a precipitation reactor having an activation zone equipped with a through-flow mixer operating on the principle of a multi-ring impact mill, and comprising several, typically 3-8, more typically 4-6, coaxial rings equipped with blades or the like, whereof at least every other ring functions as a rotor, and their adjacent rings as stators, or rotors rotating in opposite directions or at different speeds. The rotor speeds may be 5-250 m/s. The difference in speed between the adjacent rings is 10-500 m/s, typically 50-200 m/s. Mills or mixers operating according to this principle have been presented earlier in Finnish patents 105699 B, 105112 B, and WO-publication 96/18454.

In the through-flow mixer operating on the principle of an impact mill, the fibre suspension typically travels through the mixer radially outwards from the centre of the rings, making it possible for blades or corresponding devices on the rings to direct both impacts and double impacts, and to generate shear forces, turbulences and under- and overpressure pulses on the fibre suspension flowing outwards on the rings, and to activate the fibres. The reactor operating on the principle of an impact mill can efficiently treat fibre suspensions, which may have either high or very low dry matter contents, to suit the precipitation process. In the precipitation reactor according to the invention, it is possible to precipitate mineral substances of highly various dry matter contents such as 0.1-40%, typically 1-15%, more typically 3-7%. Chiefly, the pumpability of the fibre suspension in the feeding and discharge pipes sets the limit.

Adjacent rings, rotors, blades or the like in the through-flow mixer typically move in opposite directions which enable efficient, sequential impacts, chiefly in opposite directions, i.e. impacts and double impacts, to be directed in to the fibre suspension flowing through the reactor. If, on the other hand, stationary rings, i.e. stators, are fitted between the rings, i.e. rotors, rotating in the same direction, it is possible to direct impacts caused by the rotor blades, and double impacts caused by the stator blades, to the fibre suspension flowing through the reactor. A similar result is achieved with the rotors rotating in the same direction at a highly different speed.

The blades or the like of the rotors and stators in the through-flow mixer can, at the same time, direct fibre suspension to travel radially outwards from the hub of the rings. The expansion of the rotor and stator rings, when moving from the centre towards the outer ring creates a pressure difference between the inlet, i.e. the centre, and the outlet, i.e. the outer ring. The pressure decreases when moving outwards from the centre. The created pressure difference promotes transportation of the fibre suspension through the through-flow mixer.

According to an advantageous embodiment of the invention, it is a question of mechanical activation, for example, when the fibre surfaces are treated so that free and reactive surfaces are exposed from the fibre therein making it easy for precipitable mineral substances to attach, or fibrils are exposed from the fibre surfaces therein making it easy for precipitable substances to attach. The formation of fibrils increases the specific surface area of fibres, making it possible for fibres to bind more precipitable mineral substances. Part of the formed fibrils may detach from the fibre, and thus increase the fine matter of the fibre suspension, which in some cases is even desirable.

According to an advantageous embodiment of the invention, mechanical activation also comes into question, for example, when under- and overpressure pulses are affected in fibres causing them to open, tear or form holes making it easier for a greater amount of reactive mineral substances in the fibre suspension to penetrate into the fibres and to precipitate therein.

According to an advantageous embodiment of the invention, chemical activation comes into question, for example, when fibre surfaces are activated so that active chemical groups, which can bind precipitable or precipitated mineral substances, are formed on the fibre surfaces. For example, it is possible to create active $OH^-$-groups on the fibre surfaces, which are able to form bonds with the mineral substance, and cause the mineral substance to attach to the fibres.

In a typical method according to the invention, fibre material and reactive mineral substance such as lime milk, $Ca(OH)_2$, are advantageously combined to form fibre suspension before these substances are directed to the precipitation reactor. Adding a reactive mineral substance to be precipitated in to the fibre material suspension in the form of a sludge or suspension typically forms the fibre suspension, containing fibre material and a reactive mineral substance. Thus, it is possible to mix a sludge or suspension quickly and evenly into the fibre suspension. On the other hand, the reactive mineral substance to be precipitated may be added to the fibre material suspension in a solid form as well, for example, as powder. When the reactive mineral substance is added to the fibre material suspension before the suspension is fed to the precipitation reactor, the fibres have time to absorb the reactive mineral substance, for several minutes if desired, and if the mineral substance is alkaline, it will make the fibres swell to an advantageous form with regard to activation and/or carbonisation. This means that when the precipitation begins, it is possible to precipitate the mineral substance onto the fibre surfaces, as well as inside the fibres, more easily. If desired, the fibre substance and mineral substance may, of course, be directed to the precipitation reactor separately, allowing these substances to mix no sooner than in the precipitation reactor.

When the solution according to the invention is applied in the precipitation of a mineral substance, it is possible to select such conditions as raw materials, feeding proportions of raw materials, pH, pressure and temperature that are best suitable for the applicable process. The solutions according to the invention do not set any limits for these parameters.

These explanations refer to the following unless otherwise specified:

- fibre material suspension refers to a liquid based suspension containing at least the fibre material,
- fibre suspension refers a liquid based suspension containing at least the fibre material and a reactive mineral substance needed for precipitation,
- gas suspension refers to a suspension formed from at least the fibre material, reactive mineral substance and precipitating gas, in which the fibre material and reactive mineral substance are finely divided, and
- the treated fibre suspension refers to a liquid based suspension containing at least the fibre material and precipitated mineral substance particles.

The above-mentioned suspensions may also contain other substances such as already precipitated mineral particles or unprecipitated mineral substances.

In the method according to the invention, calcium hydroxide ($Ca(OH)_2$, i.e. lime milk, or other $Ca^{2+}$-ion sources can be used as a reactive mineral substance, making it possible to precipitate the so-called precipitated calcium carbonate (PCC) into the fibres and/or inside the fibres. The invention also makes it possible to use other corresponding reactive mineral substances such as calcium oxide or calcium sulphate, which may be precipitated and attached using a precipitating gas.

A reactive mineral substance to be used in precipitation is selected according to which characteristics of the fibres, paper to be manufactured or manufacturing process is desirable to improve. The mineral substance precipitating in the fibre suspension, and especially in the fibres, makes it possible to improve, for example, the whiteness, lightness, opacity, glossiness, bulk, printing result, printability, drainability, drying characteristics, etc. of paper.

A precipitating gas is preferably used as a precipitating chemical. As a precipitating gas of calcium hydroxide, it is possible to use, for example, carbon dioxide. Thus it is possible to feed carbon dioxide containing gas such as pure or nearly pure carbon dioxide ($CO_2$), combustion gas or other suitable gas for the purpose into the precipitation reactor. It is also possible to use another suitable precipitant than carbon dioxide.

The invention not only enables precipitation of precipitable reactive substances in the fibre suspension into the fibres, but also onto the surfaces of other inorganic or organic particles residing in the suspension. These particles may include, for example, other mineral substance particles such as titanium dioxide particles or impurity particles or fibre-based fine fraction particles. The solution according to the invention can thus be used to hide ink residues, which have remained in incompletely de-inked fibres, using precipitated calcium carbonate or the like. The reactive substance, which has precipitated on inorganic particles, also has the ability to attach particles onto the fibres, which are then retained in paper along with the fibres. On the other hand, mineral substances precipitated on the fibres, also have the ability to bind fibres together, which increases the strength characteristics of paper.

The fibre suspension to be fed to the precipitation reactor may, in addition to the fibre material and reactive mineral substance to be precipitated, include other solid substances used in paper manufacture or the like such as

- other mineral substances such as calcium oxide, calcium sulphate, calcium carbonate, talcum, kaolin clay or titanium dioxide,
- fibre-based fine matter, other fine matter or impurities, for example, which have detached from fibres during de-inking, various process rejects and/or
- substances used to improve retention such as starch, biocides.

The invention is suitable for use in manufacturing a paper web or pulp product manufactured from the paper, paperboard or other corresponding fibre-like material.

Thus the invention is suitable for use

- in manufacturing a wide variety of paper web products such as newsprint paper, fine grade paper, magazine printing paper, kraft paper, soft tissue, special paper or paperboard;
- in manufacturing a product from a wide variety of pulps such as chemical, mechanical, chemi-mechanical, thermomechanical pulp or semi-mechanical pulp, recycled pulp or their mixture;
- in manufacturing paper from a wide variety of fibres such as virgin fibre, chemical or mechanical fibre, bleached or unbleached fibre, refined or unrefined fibre, dried or undried fibre, de-inked or inked recycled fibre or fibre obtained from the broke pulp, or mixture of any of these.

It has now been discovered that by feeding the fibres and reactive mineral substance as a finely refined fibre suspension into the precipitating gas, i.e. in the opposite way as compared to the previous processes, it is possible to mix reactive mineral substances, fibre material and precipitating gas together remarkably easily and efficiently, with regard to precipitation.

Precipitation reactions can begin immediately and the reactions occur quickly on remarkably large contact surfaces formed between the small fibre suspension drops and the gas. Precipitation proceeds easily to fibre surfaces, as well as inside the fibres. By regulating the composition of fibre substance, the reactive mineral substance and/or composition of precipitating gas, using the method and apparatus of the invention, it is possible to control the achievable paper characteristics such as strength and optical characteristics of paper.

The finer the fibre suspension has been dispersed, i.e. disintegrated, the quicker and more efficiently reactions can be assumed to take place. Using the through-flow mixer operating on the principle of an impact mill, it is possible to disperse the fibre suspension into the precipitating gas as a mist-like gas suspension where the gas, the fibres and the reactive mineral substance to be precipitated are efficiently mixed together. Using the solution according to the invention, it is possible to microhomogenise the components participating in the precipitation event as a gas suspension where the reactions between different components can take place immediately. This is advantageous especially when, for example, the activated fibre returns easily to the inactivated state, i.e. when the fibrils and openings forming in the fibres close easily. Mineral substances residing in the fibre suspension have, at least partially, an ability to prevent the recovery of fibrils. The fibre suspension can be reactivated once or several times when necessary.

It has now also been discovered that by activating the fibre material prior to the precipitation event and/or during the precipitation event so that the ability of fibres to bind together, and to bind the precipitated mineral substance increases; it is possible both to boost the precipitation event and to improve the characteristics of paper. Even one single treatment in a precipitation reactor may suffice to obtain the desired precipitation event and paper characteristics.

The invention is referred to in the attached Figures, in which

Figure 1:
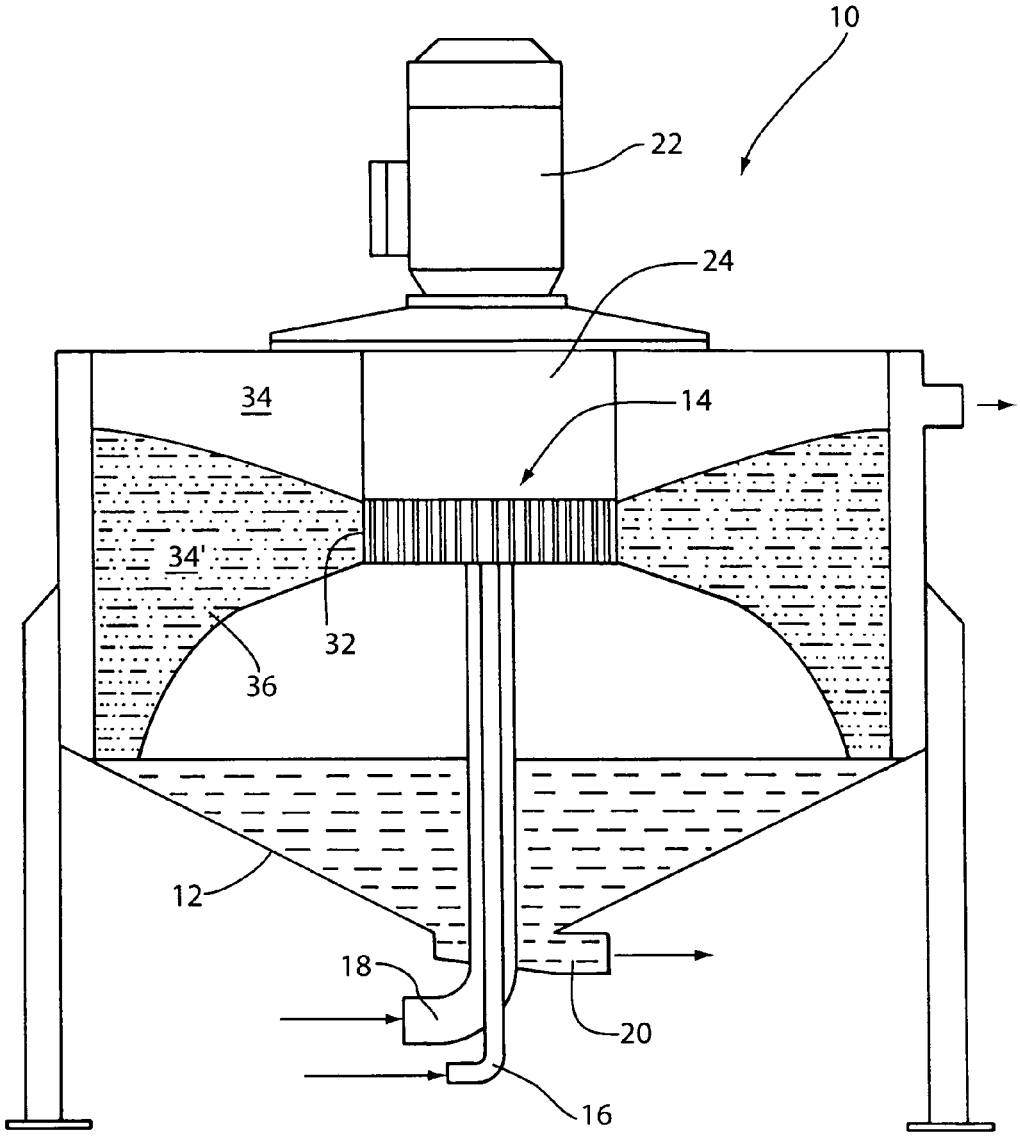
FIG. 1 illustrates schematically, as an example, a vertical cross-section of the precipitation reactor according to the invention.

FIG. 1 illustrates a continuously operating precipitation reactor 10 according to the invention, comprising a precipitation vessel 12, a disintegration and activation device 14 fitted in the precipitation vessel, a feed pipe 16 for fibre suspension, a feed pipe 18 for precipitating gas, and a discharge pipe 20 for the treated fibre suspension. Moreover, the apparatus consists of an actuator 22, including the bearing and sealing assembly 24 between the actuator 22 and the device 14.

Figure 2:
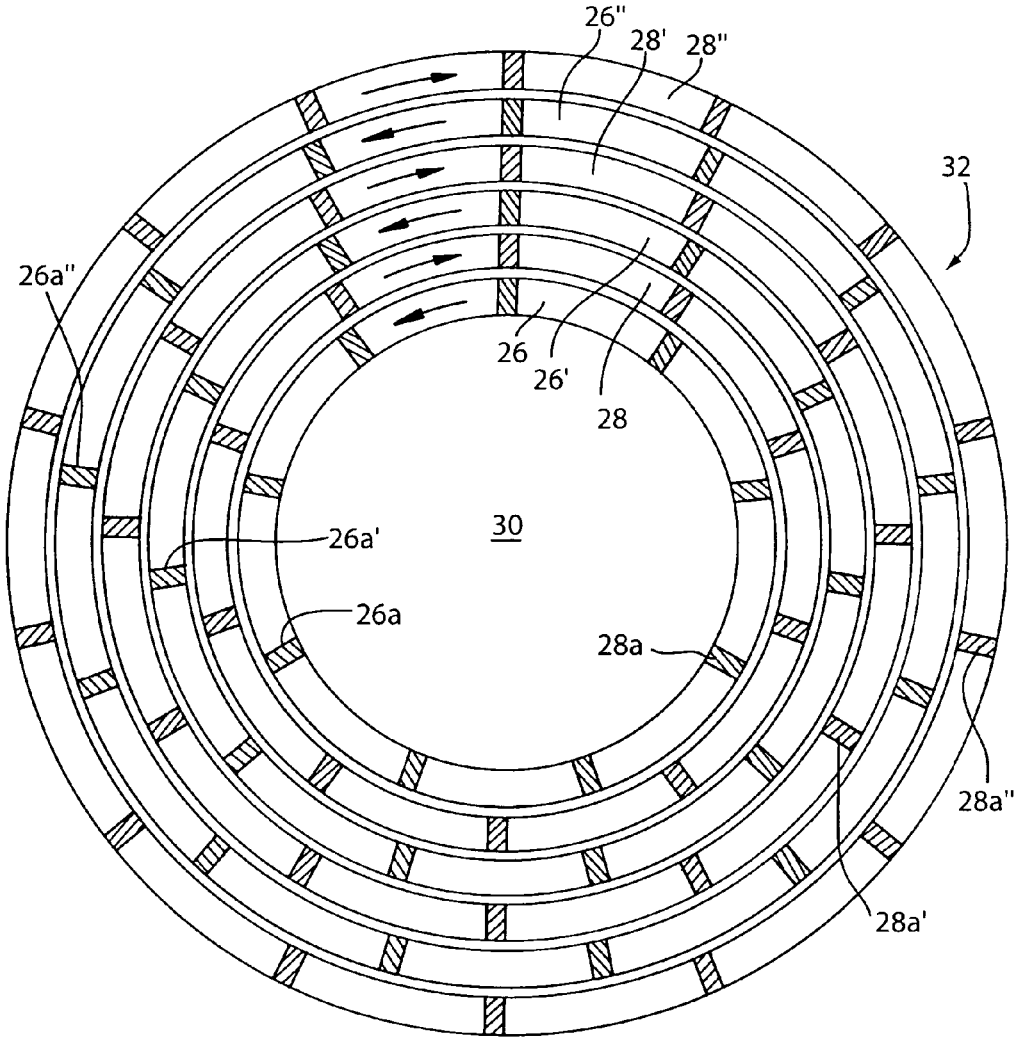
FIG. 2 illustrates schematically, as an example, a horizontal cross-section of a disintegration and activation device fitted in the precipitation reactor according to FIG. 1.

A disintegration and activation device 14, of which a horizontal cross-section is presented in FIG. 2, is a so-called through-flow mixer, which consists of 6 coaxially arranged rings 26, 26', 26", 28, 28', 28', 28" equipped with blades 26*a*, 26'*a*, 26"*a*, 28*a*, 28'*a*, 28"*a*. In the device 14, the fibre suspension is disintegrated into small fractions, liquid drops and/or solid particles. At the same time, the fibres in the fibre suspension are activated in the device 14 so that the ability of fibres to bind together and their ability to receive precipitated mineral substances increases. The dwell-time in the disintegration and activation device is short <10 s, typically <2 s, and more typically even less than 1 s.

As the arrows presented in FIG. 2 indicate, the first rings 26, 26', 26" of the disintegration device operate as rotors, which in the case presented in the figure rotate counter-clockwise. Also, the second rings 28, 28', 28" adjacent to the first rings operate as rotors; however, they rotate clockwise in the case presented in the figure. Blades 26*a*, 26*a*', 26*a*" and 28*a*, 28*a*', 28*a*", which are mounted on the rings, encounter the fibre suspension travelling through the device radially outwards, making it a target of recurrent impacts and double impacts. Simultaneously, as the blades approach each other, overpressure is formed between the blades of the adjacent rotors, and under-pressure is formed as the blades draw apart from each other. Pressure differences create very quick over- and underpressure pulses in the fibre suspension. Moreover, at the same shear forces and turbulence are generated in the fibre suspension travelling through device 14.

Fibre suspension or fibre sludge containing the fibre material and reactive mineral substance is fed through the pipe 16 to the centre section 30 of the disintegration and activation device, wherefrom the fibre suspension travels radially outwards, towards the open outer edge 32 of the outer ring 28" by the effect of the difference in pressure created between the centre and the outer ring of the device. The fibre suspension can be fed to the device 14 between the rings as well, when necessary. It is also possible to feed the fibre material and reactive mineral substance into the disintegration and activation device 14 through separate pipes, in which case the fibre suspension containing the fibre and mineral substance is not formed until in this device.

Impacts and double impacts, shear forces, turbulence, and under- and overpressure pulses, generated by the rotor blades rotating in opposite directions, disintegrate the fibre suspension to very fine fractions, liquid drops and solid particles, simultaneously activating the fibres, for example, by fibrillating them. Among other things, the activation is efficient because of powerful impacts and strong shear forces affecting the fibre suspension. In the solution according to the invention, the fibre suspension can, however, travel a relatively open route through the rings, and is therefore not exposed to similar grinding and fibre breaking forces as are the fibres which are treated in disc refiner- or cone refiner-type solutions. In the solution according to the invention, the fibres encounter the surfaces of the rotor blades for a very short time only, if at all.

In the solution according to the invention presented in FIGS. 1 and 2, the precipitating gas is directed through the pipe 18 to the centre 30 of the rings of the disintegration and activation device. From this centre location, the gas flows radially outwards generating, both in the disintegration device and in the precipitation vessel 12 around it, a gas space 34 containing the precipitating gas. The gas is discharged through the pipe 21 located on the top section of the precipitation reactor. If desired, it is possible to feed the precipitating gas into the rings and/or between the rings of the disintegration and activation device. Precipitation reactions may already begin in the gas space of the disintegration and activation device.

When treated in the disintegration and activation device 14, the fibre suspension forms very fine drops and particles, which will be dispersed from the device 14 to the surrounding section 34' of a gas space. Fine drops and particles are hurled out of the disintegration and activation device, mainly from its outer ring area, as a mist-like flow 36. The precipitation reactions outside the disintegration and activation device may continue a relatively long time as the fine drops and particles disperse widely in the precipitation vessel. The treated fibre suspension descends into the pool on the bottom of the precipitation vessel, and is discharged from the vessel through the pipe 20.

The size, shape, width and height of the precipitation vessel 12 may be selected so that the drops and particles, which are hurled out of the disintegration and activation device, remain in the gas space 34' of the precipitation vessel so that their dwell-time therein is as appropriate as possible. For example, increasing the height of the precipitation vessel 12, making it tower-like, increases the dwell-time of the fibre suspension.

Processes in the precipitation reactor 10 may also be regulated by adjusting, for example, the number of rings, the distance between the rings, the distance between the blades on each ring, and the blade dimension and position in the disintegration and activation device.

The fibre suspension exiting through the bottom of the precipitation vessel 12 can be recycled to the same precipitation reactor, or be fed to another reactor to finish the treatment.

Figure 3:
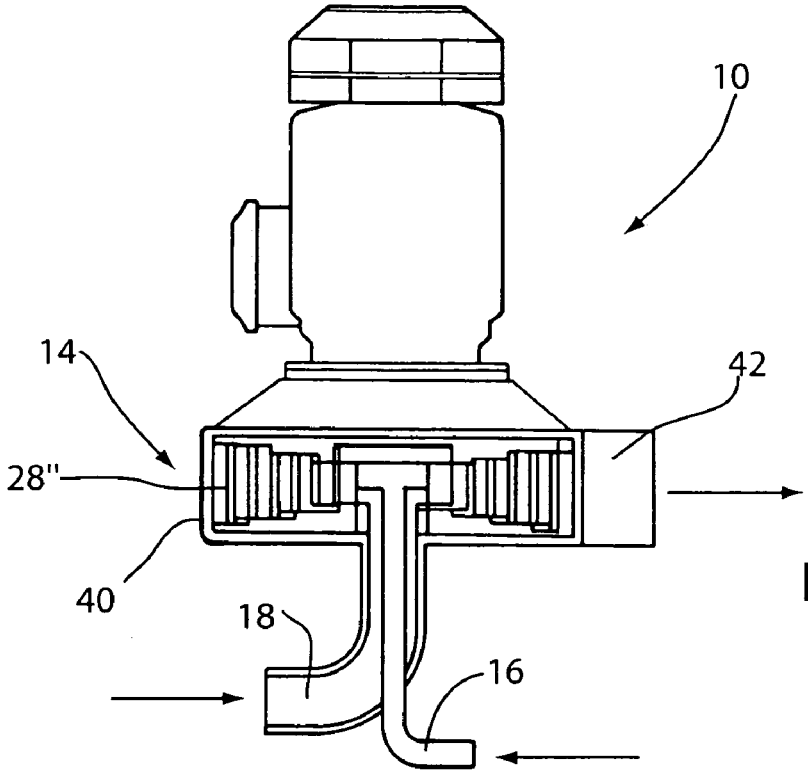
FIG. 3 illustrates schematically, as an example, a vertical cross-section of another precipitation reactor according to the invention.
Figure 4:
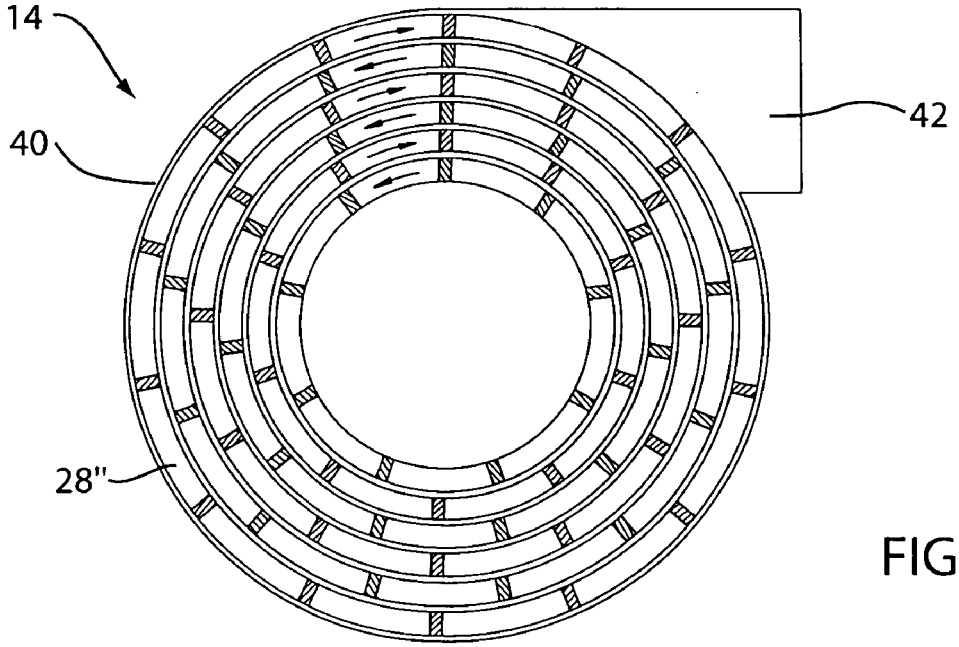
FIG. 4 illustrates schematically, as an example, a horizontal cross-section of a disintegration and activation device of the precipitation reactor presented in FIG. 3.

FIGS. 3 and 4, which illustrate another precipitation reactor according to the invention with its disintegration and activation reactors, use the same reference numbers as presented in FIGS. 1 and 2, when applicable. According to the invention, another precipitation reactor 10 presented in FIG. 3 differs from the device presented in FIGS. 1 and 2 mainly so that the reactor comprises a disintegration and activation reactor 14 equipped with a closed outer ring 32, and that the precipitation reactor does not include a separate precipitation area reaching outside the disintegration and activation device. The solution presented in FIGS. 3 and 4 is suitable to be used, for example, when the precipitation reactions may be assumed to be completed as desired already in the gas space of the disintegration and activation reactor.

In the disintegration device presented in FIGS. 3 and 4, the outermost ring 28" is surrounded by a housing 40, which closes the ring. The housing comprises a discharge opening 42 for discharging the treated fibre suspension from the device 14. The treated fibre suspension may be directed from the discharge opening 42 through the pipe for further treatment or process.

Figure 5:
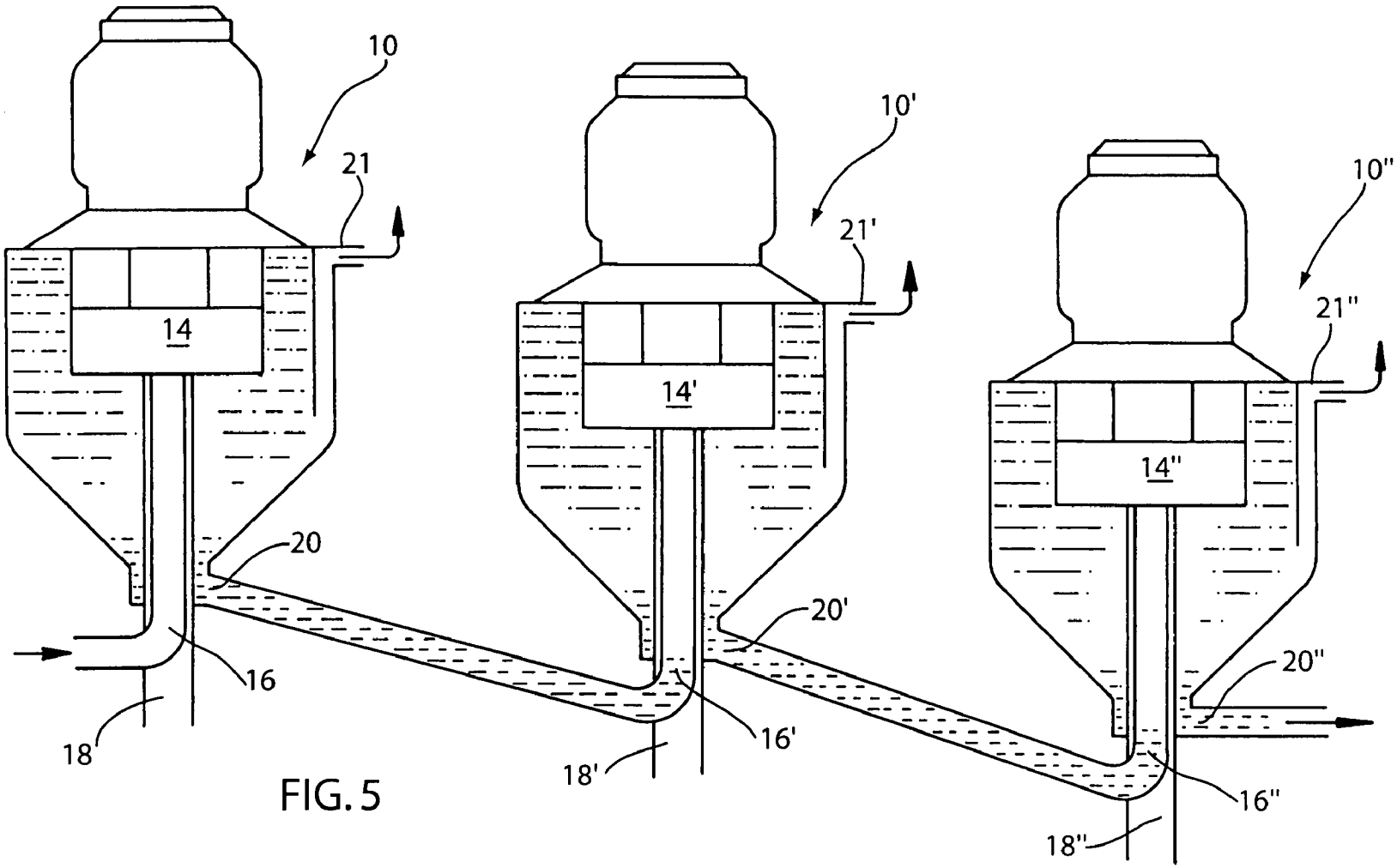
FIG. 5 illustrates schematically, as an example, a vertical cross-section of a precipitation reactor group according to the invention.

The reactor presented in FIG. 3 is also applicable for use in the activation of fibre suspension when the precipitation does not occur in this device. Two or more of both types of precipitation reactors presented in FIG. 1 and FIG. 3 can be arranged in a sequential series. FIG. 5 illustrates a group of three precipitation reactors of the type presented in FIG. 1. When applicable, the reference numbers are the same as in the previous diagrams.

FIG. 5 illustrates three precipitation reactors 10, 10' and 10", where the fibre suspension containing $Ca(OH)_2$ is treated with $CO_2$-gas for carbonising $Ca^{2+}$-ions, i.e. to precipitate $CaCO_3$. The reactors are connected sequentially so that the partially treated fibre suspension containing fibre, precipitated carbonate and unprecipitated calcium hydroxide is directed from the discharge opening 20 of the first reactor 10 to the feed pipe 16' of the second reactor 10'. Correspondingly, the treated fibre suspension is directed through the discharge pipe 20 of the second reactor 10' to the feed pipe 16" of the third reactor 10".

Carbon dioxide containing gas is led to each reactor through the pipes 18, 18', 18". Carbon dioxide containing gas is fed through the feed pipe 18 to the first reactor 10, which induces precipitation (carbonisation) and the formation of active carbonate to the fibres already in the disintegration and activation device 14. Precipitated calcium carbonate precipitates both on fibres as well as on other particles residing in the fibre suspension. Carbonate also precipitates as separate particles into the fibre suspension. It is possible to direct the same or other carbon dioxide containing gas to the second and the third precipitation reactors 10', 10" through pipes 18', 18" in order to complete the precipitation reactions (carbonisation). The gas is removed from the reactors through discharge pipes 21, 21', 21".

The fibre suspension to be fed to the precipitation reactor 10 can be activated in a separated activation device connected in front of the precipitation reactor 10. The activation device is advantageously an impact mill-type of a through-flow mixer.

Figure 6:
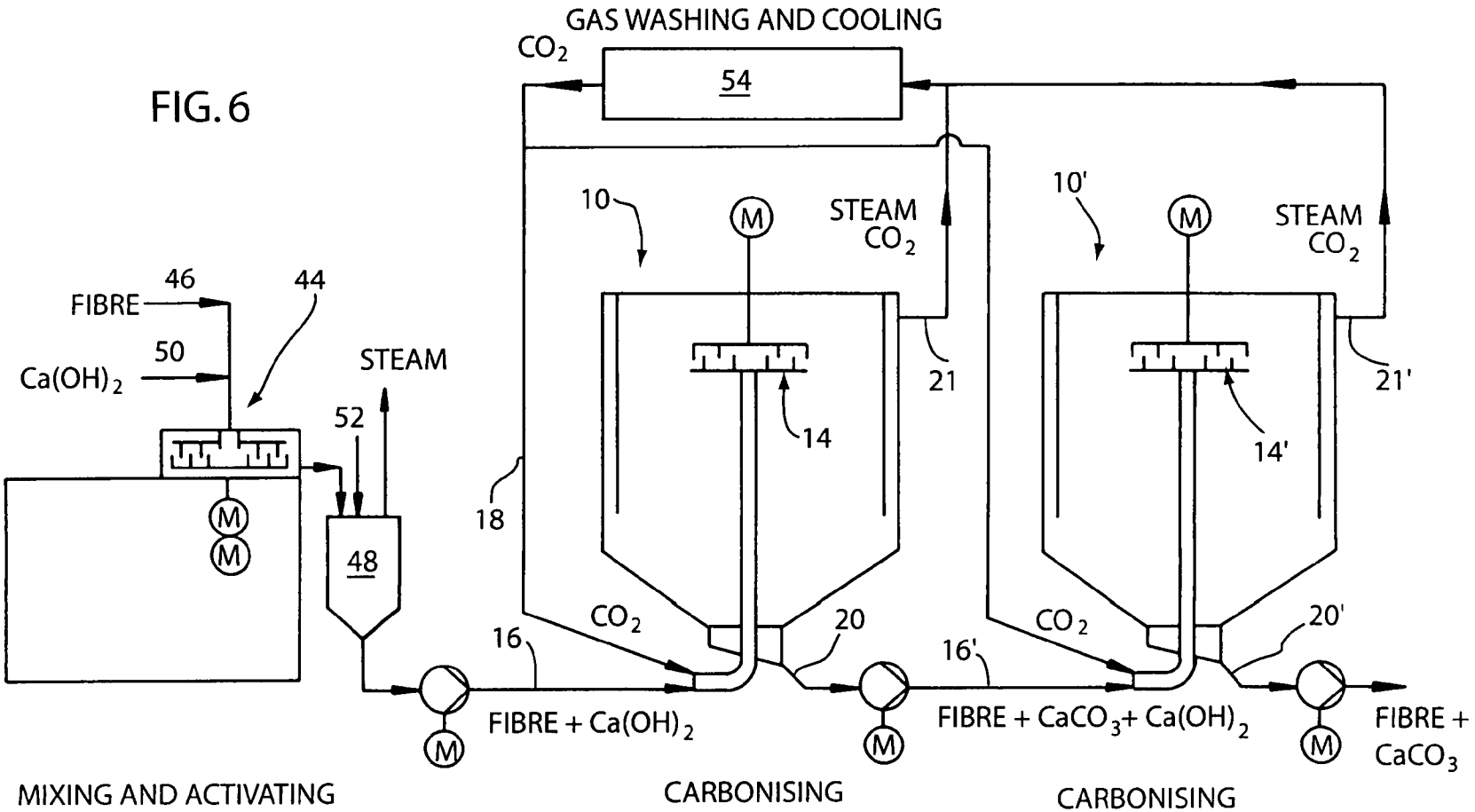
FIG. 6 illustrates schematically, as an example, a vertical cross-section of another precipitation reactor group according to the invention.

FIG. 6 illustrates another precipitation reactor group, having two precipitation reactors 10, 10', according to the type presented in FIG. 1, fitted sequentially in series. An activation device 44, the structure of which resembles chiefly a through-flow mixer presented in FIG. 3, is connected in front of the first precipitation reactor 10. The fibre material to be fed to the precipitation reactor is activated in the activation device. Precipitating gas, however, is not fed to the activation device.

Fibre material is led through the pipe 46 at the top to the activation device 44. Activated fibre material is directed through the break tank 48 into the first precipitation reactor 10. It is also possible to add to the fibre material the mineral substance to be precipitated, calcium hydroxide, through the pipe 50 in front of the activation device 44, or through the pipe 52 behind the activation device. In the break tank 48, the fibre material is allowed to swell in alkaline conditions for a desired time. From the break tank the fibre suspension containing fibre material and mineral substance to be precipitated is led through the pipe 16 at the bottom to the disintegration and activation device 14 of the precipitation reactor. A precipitating gas 18, typically carbon dioxide, is fed along with the fibre suspension to the device 14. The gas, typically containing steam and carbon dioxide, is removed from the top section of the precipitation reactor through the pipe 21. The gas is directed for treatment in a gas washing and cooling device 54. In the device 54, the treated carbon dioxide containing gas is recycled through the pipe 18 back to the precipitation reactor 10. The treated fibre suspension gathered at the bottom section of the precipitation reactor is removed through the discharge pipe 20.

The second precipitation reactor 10' presented in FIG. 6 operates mainly on the same principle as the first precipitation reactor 10. The fibre suspension, which is removed from the bottom of the first reactor 10 to the pipe 20 and which typically contains the fibre material and calcium hydroxide in addition to the precipitated calcium carbonate, is directed through the pipe 16' from the bottom to the disintegration and activation device 14' of the second reactor 10'. From the washing and cooling device 54, the carbon dioxide containing gas is directed to the second reactor 10'. The nearly completely treated fibre suspension, in which a desired amount of calcium carbonate has precipitated into the fibres, is discharged via the bottom of the second reactor 10' through the pipe 20'. The gas is removed from the top section of the second reactor 10', and is led to the washing and cooling device 54 for further recycling.

Figure 7:
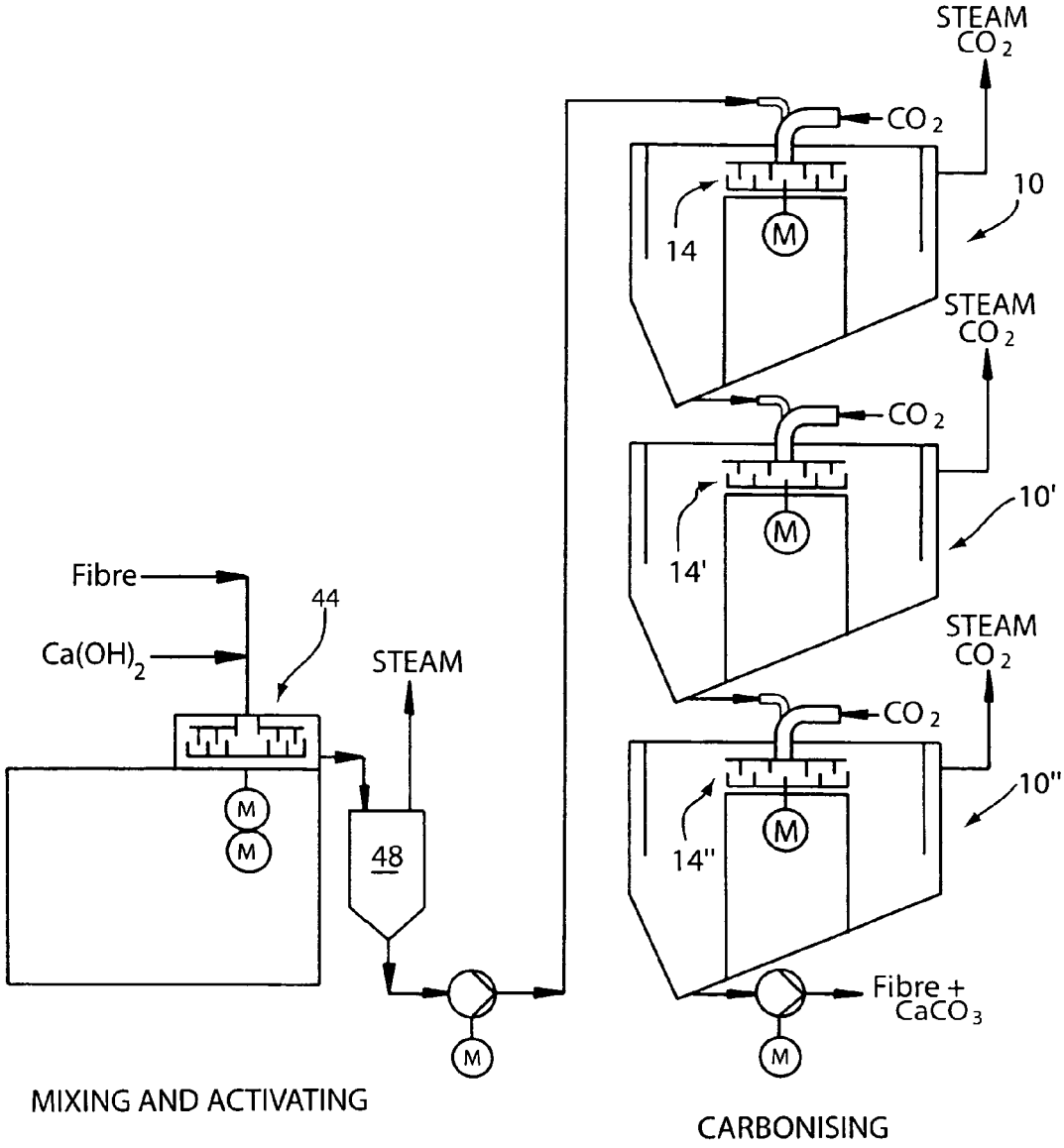
FIG. 7 illustrates schematically, as an example, a vertical cross-section of a third precipitation reactor group according to the invention.

FIG. 7 illustrates a third precipitation reactor group comprising three precipitation reactors 10, 10', 10" fitted in series. The reactors are fitted on top of each other, and the fibre suspension is fed from the top to the disintegration and activation devices located in the reactors. The first reactor 10 is topmost and the third reactor 10" is lowermost, denoting that the fibre suspension flows mostly downwards when travelling through the reactors. A separate pre-activation device 44 and a break tank 48 for fibre material are fitted in front of the precipitation reactor group as presented in FIG. 6.

Among other things, advantages of the invention include

- the possibility to both activate and disintegrate the fibre material simultaneously for precipitation,
- the possibility to achieve quick, efficient and complete precipitation reactions; even a single run-through in the precipitation reactor yields good results;
- the activation enabling strong and efficient treatment of fibres without radically breaking or damaging the fibres in any other way;
- the possibility to regulate activation;
- the possibility to achieve highly efficient mixing of fibre suspension, mineral substances and gas, which means that each small volume unit in the fibre suspension is treated, and that precipitation takes place in each volume unit;
- the possibility to affect precipitation inside the fibres as well;
- the precipitation reactions making it possible to bind fibres together in which case it may be assumed that strength characteristics of paper increase;
- the possibility to hide ink residues, which have remained in fibres after de-inking, using precipitation reactions;
- the use of precipitation reactions makes it possible to bind inorganic and organic particles to fibres, and have them retained in paper;
- the possibility to optimise such characteristics as lightness, strength, and opacity of the paper to be manufactured through precipitation.

The purpose of the experiments presented in the following example is to compare the carbonisation of the fibre/PCC-product processed using the solution according to the invention, and the carbonisation of the fibre/PCC-product processed using other presented methods. The purpose is only to illustrate the invention, not to restrict it.

The following were used in all experiments:

- similarly machine-refined pine fibre for producing fine paper, whose consistency was approximately 3.5%,
- a $Ca(OH)_2$-sludge, whose dry matter content was about 17%, and
- a $CO_2$-containing gas, whose composition was the same.

(K1) Using the method according to the invention, a fibre/PCC-product was processed by mixing a necessary amount of $Ca(OH)_2$-sludge with the fibre stock containing pine fibre, so that the fibre/PCC-proportion was 70/30 after the precipitation, and further, pumping the fibre/$Ca(OH)_2$-suspension twice through the precipitation reactor presented in FIG. 1. The fibre/$Ca(OH)_2$-suspension was then pumped, according to the invention, as a fine-grained suspension into the $CO_2$-containing gas. An excess amount of $CO_2$-containing gas was fed into the device. After this treatment, the pH of the fibre/PCC-product was 7.

(V1) In comparison, a fibre/PCC-product was processed using a fluidising chemical mixer by pumping the fibre/$Ca(OH)_2$-suspension six times through the chemical mixer. In addition, an excess amount of $CO_2$-containing gas was fed into the chemical mixer. Immediately after the treatment, the pH of the fibre/PCC-product was 7.

(V2) As another comparison, precipitation corresponding to the experiment (V1) was carried out, except that the chemical mixer was not allowed to fluidise, only an excess amount of $CO_2$-containing gas was fed to the mixer. The fibre/$Ca(OH)_2$-suspension was pumped eight times through the chemical mixer. Immediately after the treatment, the pH of the fibre/PCC-product was 7.

(K1) When the product was processed using the method according to the invention, the pH of the product was 7 even 24 hours after the experiment, which proves that carbonisation was complete.

(V1) The pH was 10 of the product processed using the method in this example 24 hours after the experiment, which proves that carbonisation was not complete, and carbonisation of the product had to be continued for several minutes in order to complete the carbonisation reactions.

(V2) The pH was 11 of the product processed using the method in this example 24 hours after the process, which proves that carbonisation was not complete, and carbonisation of the product had to be continued for several minutes in order to complete the carbonisation reactions.

In all cases the time used for actual carbonisation was short, but only in the method according to the invention, the carbonisation was complete within a very short time, and no further carbonisation was needed.

The purpose is not to restrict this invention to the embodiments presented as examples above. On the contrary, the purpose is to enable broad use of the invention within the scope of the claims.

Therefore, the solution according to the invention may be used in other types of fibre material pretreatment when manufacturing paper, paperboard or the like, in order to activate the fibres and their surfaces, for example, so that their ability to bind together either mechanically or chemically increases, their ability to bind mineral substances either mechanically or chemically increases, active OH-groups are formed on their surfaces and/or their lumen opens so that a mineral substance can precipitate inside the fibres as well. In this case, the fibre material is pretreated in a through-flow mixer operating on the principle of an impact mill comprising several, more typically 3-8, most typically 4-6, coaxial rings equipped with blades, in which at least every other ring operates as a rotor, and the adjacent rings of these rings as stators or rotors, the difference in speed of the adjacent rings being 10-500 m/s, typically 50-200 m/s, feed devices for supplying the fibre material mainly to the centre of the said rings, and an open outermost ring, which allows the fibre suspension that has flowed radially outwards through the rings, to leave the ring in different directions; or the outermost ring equipped with one or more discharge openings for discharging the fibre suspension, having flowed radially outwards through the rings from the precipitation reactor.

Pretreatment is advantageously performed when the fibres are swollen, for example, by the effect of adding $Ca(OH)_2$. The pretreatment of fibres, according to the invention, is especially well suited for use in activating the fibre material before the fibre material comes in contact with the reactive mineral substance whereby the mineral substance is intended to be precipitated on the fibres. Pretreatment according to the invention is well-suited for other processes in which the aim is to pretreat fibre material for achieving the necessary corresponding characteristics in the fibre material.

The invention claimed is:

1. Method for precipitating mineral particles on fibres to be used for manufacturing paper, paperboard or the like, which method consists essentially of:

(a) a fibre material containing the fibres to be used in manufacturing is fed into a precipitation reactor;

(b) a reactive mineral substance is fed into the precipitation reactor;

(c) the reactive mineral substance and fibre material are mixed to form a fibre suspension in the precipitation reactor and/or before these substances are fed into the precipitation reactor;

(d) the fibre suspension in the precipitation reactor is exposed to a substance which precipitates at least partially said reactive mineral substance, in which case at least part of the precipitated mineral substance thus formed precipitates on fibres residing in the fibre suspension, (e) the thus treated fibre suspension is led out of the precipitation reactor, (f) a gas which contains carbon dioxide is fed into the precipitation reactor, for forming a gas space containing said precipitant in the precipitation reactor, and (g) the fibre suspension that has been fed and/or that is formed in the precipitation reactor is disintegrated as small solid particles or liquid drops and/or particles into said gas space, wherein the fibre material is activated in an activation zone before the precipitation so that the ability of the fibres to bind with each other and to bind precipitated mineral substance increases, and that the dwell-time of the fibre material in the activation zone is <10 seconds, and wherein the activation zone of the precipitation reactor comprises an impact mill, having several coaxially arranged rings equipped with blades, of which at least every other ring operates as a rotor, and the adjacent rings of these rings as stators or rotors, and in which the difference in speed between the rotors and the stators and rotors of adjacent rings is 10-500 m/s, and wherein the fibre suspension is supplied so as to move from the centre of the impact mill radially outwards through its rings, in which case the blades on the rings direct recurrent impacts, double impacts, shear forces and/or over- and underpressure pulses on the fibre suspension flowing outwards, which all together activate the fibres, and optionally precipitating additional mineral particles onto said treated fibre suspension by repeating (a)-(q) at least once.

2. Method according to claim 1, wherein in stage (g) the liquid phase of the fibre suspension is disintegrated as small liquid drops, whose diameter is predominantly <10 mm, into the gas space.

3. The method of claim 2, wherein the diameter of said small liquid drops is <1 mm.

4. Method according to claim 1, wherein said rotors rotate at a speed of 5-250 m/s.

5. Method according to claim 1, wherein at least part of the gas to be fed into the precipitation reactor, containing a substance precipitating the mineral substance, is fed to the precipitation reactor through the activation zone, in which case the fibres activated in this activation zone come into contact with said precipitant immediately after activation.

6. Method according to claim 1, wherein the dwell-time of the fibre suspension containing the fibre material and the reactive mineral substance in the activation zone is <2 s.

7. The method of claim 6, wherein the dwell-time of the fibre suspension containing the fibre material and the reactive mineral substance in the activation zone is 1<s.

8. Method according to claim 1, wherein gas containing >5% of precipitant is fed into the precipitation reactor.

9. The method of claim 8, wherein the gas contains >10% of precipitant.

10. The method of claim 9, wherein the precipitant is carbon dioxide.

11. The method of claim 8, wherein the precipitant is carbon dioxide.

12. Method according to claim 1, wherein gas containing the precipitant is pure or nearly pure carbon dioxide, combustion gas or other carbon dioxide-containing gas, or is a mixture of these gases, and that gas containing the precipitant is fed into the precipitation reactor so that overpressure is maintained in the precipitation reactor.

13. Method according to claim 1, wherein the fibre suspension is led through two or several precipitation reactors wherein the gas composition of the gas spaces is different such that the gas containing the precipitant in the first precipitation reactor is pure or nearly pure carbon dioxide, and in the next precipitation reactor or in the one after that the gas is a combustion gas or another gas less rich in carbon dioxide content, or that the gas containing the precipitant in the first reactor(s) is less rich in carbon dioxide content, and in the next precipitation reactor or in the next after that, the gas is pure or nearly pure carbon dioxide.

14. Method according to claim 1, wherein the reactive mineral substance consists of calcium hydroxide, calcium sulphate, calcium oxide or other reactive mineral substance and/or their mixture, which is suitable to be precipitated with a precipitant, and the reactive mineral substance is selected so that the product to be manufactured from fibres is brought the desired characteristics.

15. Method according to claim 1, wherein the fibre material comprises virgin fibre obtained from chemical, mechanical, chemimechanical, thermo-mechanical or corresponding process;

de-inked or inked recycled fibre obtained from newsprint, kraft paper, soft paper, special paper or paper board, or fibre obtained from broken or other corresponding fibre, bleached or unbleached fibre, refined or unrefined fibre, dried or undried fibre, or any mixture of any of these.

16. Method according to claim 1, wherein fibre material contains fibres, in addition to fine matter such as fibre based fine matter, impurities and/or mineral substances.

17. A method according to claim 1, wherein fibre material is fed into the precipitation reactor at a dry matter content of 0.1-40%.

18. The method of claim 17, wherein the fibre material is fed into the precipitation reactor at a dry matter content of 1-15%.

19. The method of claim 18, wherein the fibre material is fed into the precipitation reactor at a dry matter content of 3-7%.

20. The method of claim 1, wherein the reactive mineral substance is calcium hydroxide.

21. The method of claim 1, wherein the substance precipitating reactive mineral substance is carbon dioxide.

22. The method of claim 1, wherein the fibres are mechanically activated by fibrillating or refining the fibers and opening their lumens for mineral substances, and/or the fibre surfaces are chemically activated by forming active —OH— groups on the fibre surfaces.

23. The method of claim 1, wherein the impact mill has 3-8 coaxially arranged rings equipped with blades.

24. The method of claim 1, wherein the impact mill has 4-6 coaxially arranged rings equipped with blades.

25. The method of claim 1, wherein the difference in speed between the rotors and the stators and rotors of adjacent rings is 50-200 m/s.

* * * * *